US011754011B2

(12) United States Patent
Inaba et al.

(10) Patent No.: US 11,754,011 B2
(45) Date of Patent: Sep. 12, 2023

(54) INJECTION CONTROL DEVICE

(71) Applicant: DENSO CORPORATION, Kariya (JP)

(72) Inventors: Masashi Inaba, Kariya (JP); Yusuke Shimizu, Kariya (JP); Hiroki Kakui, Kariya (JP)

(73) Assignee: DENSO CORPORATION, Kariya (JP)

( * ) Notice: Subject to any disclaimer, the term of this patent is extended or adjusted under 35 U.S.C. 154(b) by 33 days.

(21) Appl. No.: 17/339,065

(22) Filed: Jun. 4, 2021

(65) Prior Publication Data

US 2021/0381457 A1 Dec. 9, 2021

(30) Foreign Application Priority Data

Jun. 8, 2020 (JP) ..... 2020-099422

(51) Int. Cl.
*F02D 41/20* (2006.01)
*F02D 41/30* (2006.01)

(52) U.S. Cl.
CPC ..... *F02D 41/20* (2013.01); *F02D 41/30* (2013.01); *F02D 2041/2006* (2013.01); *F02D 2041/2017* (2013.01); *F02D 2041/2051* (2013.01)

(58) Field of Classification Search
CPC ..... F02D 2041/2006; F02D 2041/2017; F02D 2041/2051; F02D 41/20; F02D 41/30
See application file for complete search history.

(56) References Cited

U.S. PATENT DOCUMENTS 6,441,655 B1 * 8/2002 Fallahi ..... H03L 7/0996 331/25
10,428,759 B2 * 10/2019 Kiuchi ..... F02D 41/401
2010/0242920 A1 * 9/2010 Omori ..... F02D 41/20 123/490
2011/0220069 A1 * 9/2011 Hatanaka ..... F02D 41/20 123/490
2016/0237937 A1 * 8/2016 Kusakabe ..... F02D 41/247
2017/0335789 A1 * 11/2017 Kiuchi ..... F02D 41/20
2019/0093589 A1 3/2019 Nambu

FOREIGN PATENT DOCUMENTS

JP 2018-071449 A 5/2018

* cited by examiner

*Primary Examiner* — Carl C Staubach
(74) *Attorney, Agent, or Firm* — POSZ LAW GROUP, PLC

(57) ABSTRACT

An injection control device includes: a boost controller performing a boost switching control of a boost switch to charge a boost capacitor and supplying a boost power from a battery power supply; a boost voltage monitor monitoring the boost voltage; and a boost monitor timing controller setting a section from a predetermined time after an on-edge of the boost switch to an off-edge timing in a section monitor mode as a boost monitor section. The boost controller stops boosting by stopping the boost switching control when the boost voltage is equal to or higher than a boost stop threshold value in the boost monitor section.

12 Claims, 9 Drawing Sheets

INJECTION CONTROL DEVICE

CROSS REFERENCE TO RELATED APPLICATION

The present application is based on and claims the benefit of priority of Japanese Patent Application No. 2020-099422, filed on Jun. 8, 2020, the disclosure of which is incorporated herein by reference.

TECHNICAL FIELD

The present disclosure generally relates to an injection control device.

BACKGROUND INFORMATION

The injection control device performs a boost switching control of a boost switch to charge a boost capacitor, and supplies a boost power from a battery power source

SUMMARY

It is an object of the present disclosure to provide an injection control device capable of avoiding a decrease in boost speed and appropriately performing injection control.

BRIEF DESCRIPTION OF THE DRAWINGS

Objects, features, and advantages of the present disclosure will become more apparent from the following detailed description made with reference to the accompanying drawings, in which.

DETAILED DESCRIPTION

Figure 1:
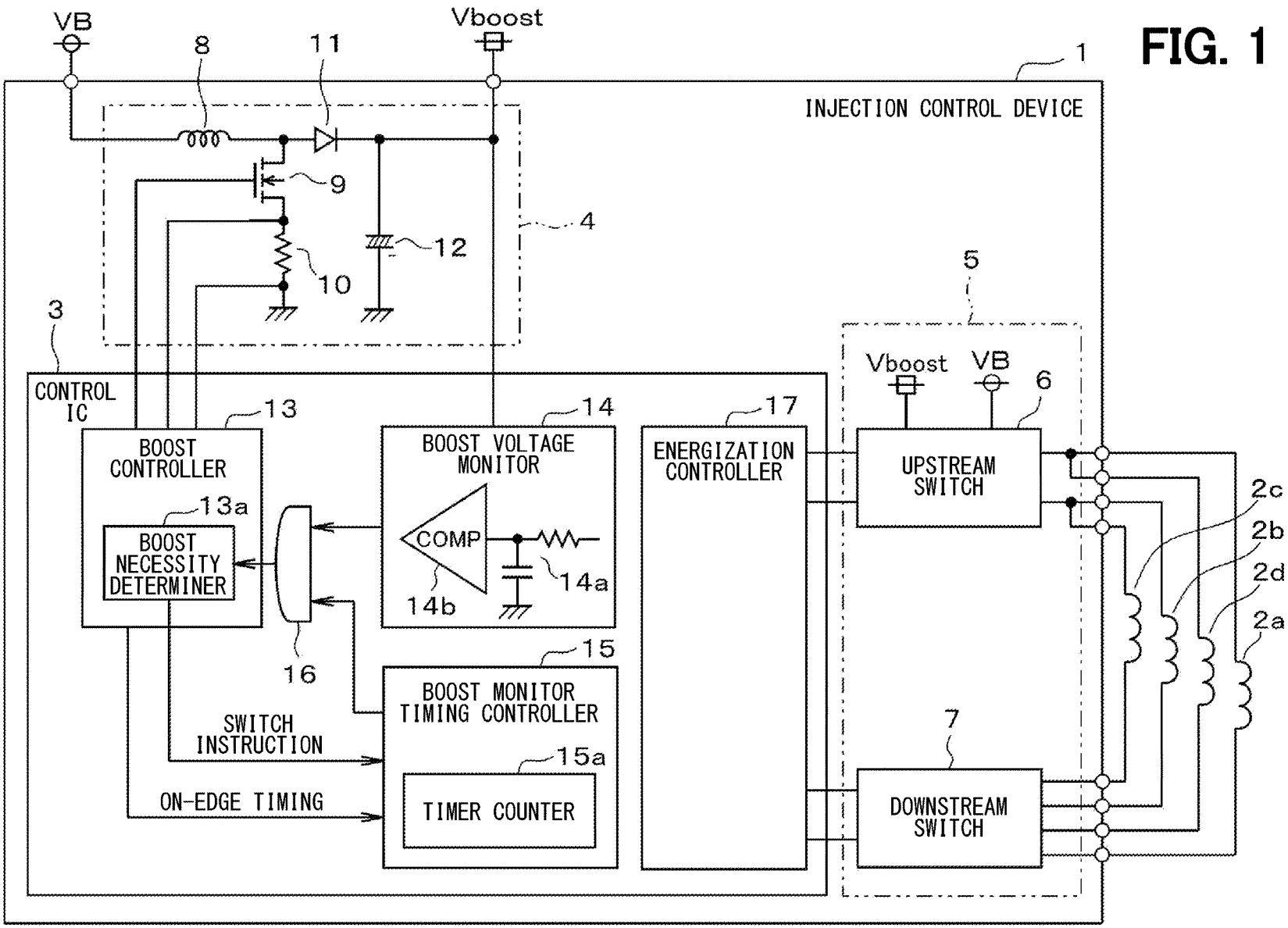
FIG. 1 is a functional block diagram showing a configuration according to a first embodiment.

Hereinafter, embodiments of the present disclosure are described with reference to the drawings. In the following embodiments, elements corresponding to those which have been described in a preceding embodiment are denoted by the same reference numerals, and redundant description may be omitted.

First Embodiment

A first embodiment is described with reference to FIG. 1 to FIG. 5. As shown in FIG. 1, an injection control device 1 is a device that controls the driving of solenoid-type fuel injection valves 2*a* to 2*d*. The fuel injection valves 2*a* to 2*d* are configured to inject fuel into an internal combustion engine mounted on a vehicle such as an automobile. The injection control device 1 is implemented as an electronic control unit (ECU). The fuel injection valve 2*a* and the fuel injection valve 2*d* are arranged in cylinders having opposite phases. As such, the injection of the fuel injection valve 2*a* and the injection of the fuel injection valve 2*d* do not overlap with each other. The fuel injection valve 2*b* and the fuel injection valve 2*c* are arranged in cylinders having opposite phases. As such, the injection of the fuel injection valve 2*b* and the injection of the fuel injection valve 2*c* do not overlap with each other. In other words, (A) the injection of the fuel injection valve 2*a* and the injection of the fuel injection valve 2*d* and (B) the injection of the fuel injection valve 2*b* and the injection of the fuel injection valve 2*c* are in an overlapping relationship with each other. In the present embodiment, a configuration of four cylinders with four fuel injection valves 2*a* to 2*d* is illustrated. However, any number of cylinders may be used, and the configuration can be applied to six cylinders, eight cylinders and the like, for example.

The injection control device 1 includes a control IC 3, a boost circuit 4, and a drive circuit 5. The control IC 3 may be, for example, an integrated circuit device using an ASIC. The control IC 3 includes, for example, a controller such as a CPU or a logic circuit, a storage such as a RAM, a ROM, or an EEPROM, and comparators. The control IC 3 is configured to perform various control processes based on hardware and software. When a sensor signal is input from an external sensor (not shown), the control IC 3 calculates an injection instruction timing, and drives the drive circuit 5 according to the calculated injection instruction timing.

The drive circuit 5 includes an upstream switch 6 and a downstream switch 7. The upstream switch 6 is a switch provided on an upstream side of the fuel injection valves 2*a* to 2*d*, and includes a peak current drive switch (also known as a discharge switch, not shown) for turning ON/OFF of discharge of a boost power supply Vboost to the fuel injection valves 2*a* to 2*d*, and a battery voltage drive switch (also knowns as a constant-current switch, not shown) for performing constant current control using a battery power supply VB. The boost power supply Vboost is, for example, 65 volts, and the battery power supply VB is, for example, 12 volts. The peak current drive switch and the battery voltage drive switch may, for example, be implemented as an n-channel type MOS transistor, but other types of transistors such as bipolar transistors may be used as well. The downstream switch 7 is a switch provided on a downstream side of the fuel injection valves 2*a* to 2*d*, and includes a low-side drive switch for selecting a cylinder. Similar to the peak current drive switch and the battery voltage drive switch, the low-side drive switch may be implemented as an n-channel type MOS transistor, but other types of transistors such as bipolar transistors may be used as well.

The drive circuit 5 is driven by switching control of the upstream switch 6 and the downstream switch 7 according to an energization current profile by an energization controller 17 described later. When driven, the drive circuit 5 controls the opening and closing of the fuel injection valves 2*a* to 2*d* by performing peak current drive and constant current drive of the fuel injection valves 2*a* to 2*d*, and controls the injection of fuel into the internal combustion engine from the fuel injection valves 2*a* to 2*d*.

The boost circuit 4 is implemented as a DC/DC converter with a chopper circuit, which includes, for example, a boost coil 8 composed of an inductor, a boost switch 9 composed of, for example, a MOS transistor, a current detection resistor 10, a boost diode 11, and a boost capacitor 12 in the illustrated form. The specific structure of the boost circuit 4 is not limited to the illustrated form, and various structures can also be used. In the boost circuit 4, according to switching of the boost switch 9 under boost switching control of the boost controller 13, which will be described later, energy of the electric current stored in the boost coil 8 is rectified by the boost diode 11, and the rectified current energy is stored in the boost capacitor 12 by charging the boost capacitor 12, and the battery power supply VB is thus boosted to generate the boost power supply VBoost. An aluminum electrolytic capacitor may be used as the boost capacitor 12.

The control IC 3 includes a boost controller 13, a boost voltage monitor 14, a boost monitor timing controller 15, a logical AND circuit 16, and the energization controller 17. The functions provided by the control IC 3 can be provided by (a) a combination of software stored in a memory device, and a computer that executes the software, (b) software only, (c) hardware only, or (d) a combination thereof.

Figure 2:
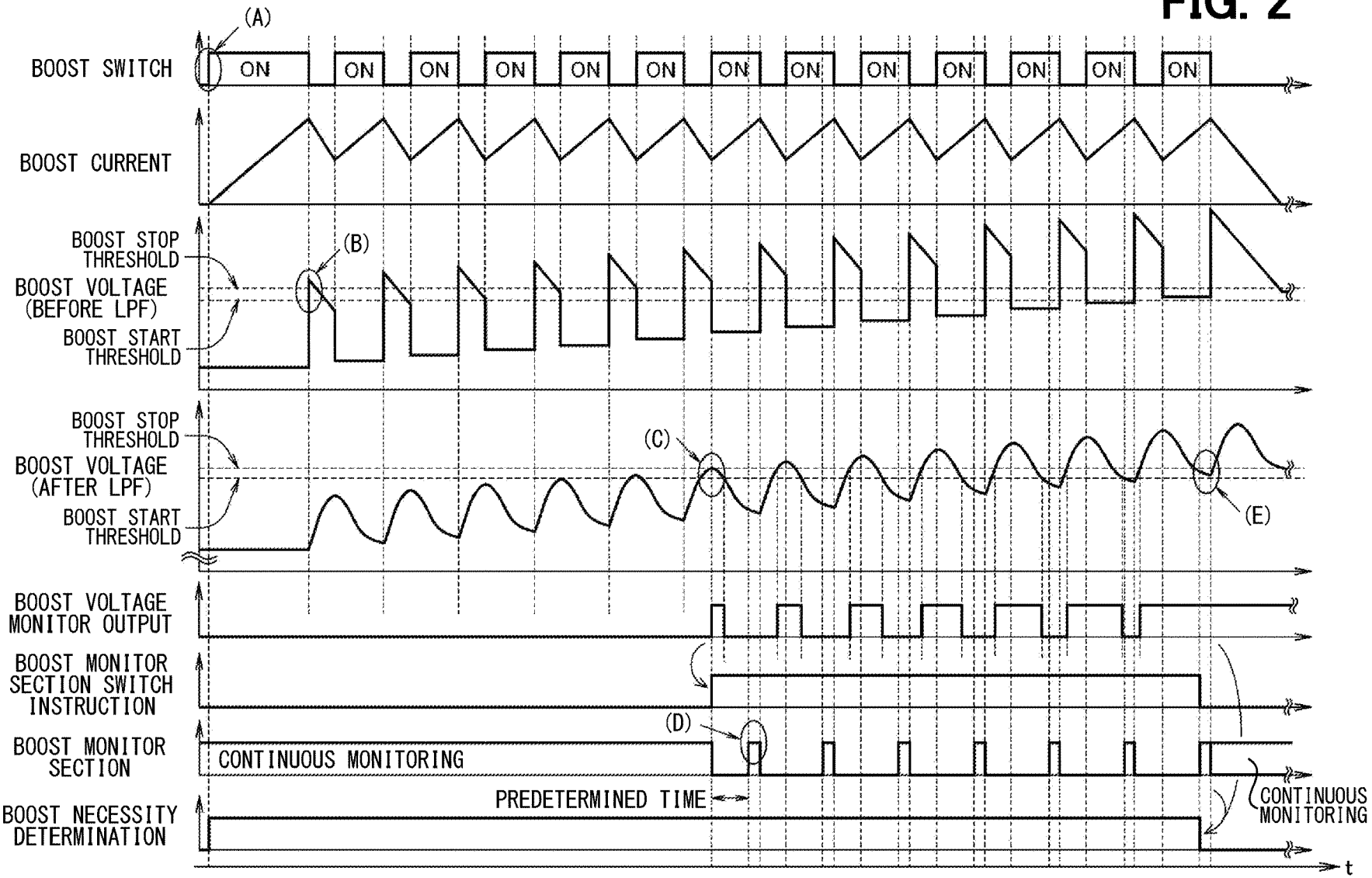
FIG. 2 is a timing chart showing an operation sequence of boost stop determination.

The boost controller 13 detects the current flowing through the current detection resistor 10, determines whether boosting is necessary or not by a boost necessity determiner 13*a*, and, upon determining that boosting is required when the boost voltage is equal to or lower than the boost start threshold (also known as Vstartboost), starts the boost switching control by the boost switch 9 to start boosting (see (A) in FIG. 2). When the boost current flows into the boost capacitor 12 due to the start of boosting, the boost voltage promptly jumps up by about 10 V due to ESR (Equivalent Series Resistance), which is a DC resistance component of the aluminum electrolytic capacitor (see (B) in FIG. 2).

The boost voltage monitor 14 detects the voltage between an anode and a ground of the boost capacitor 12, and monitors the boost voltage. As a monitor mode for monitoring the boost voltage, the boost voltage monitor 14 can switch between a continuous monitor mode (CMM) for continuously monitoring the boost voltage and a section monitor mode (SMM, also knowns as an intermittent monitor mode) for intermittently monitoring the boost voltage, for monitoring of the boost voltage. The boost voltage monitor 14 compares the boost voltage after passing through a low-pass filter 14*a* with a preset boost stop threshold value and a preset boost start threshold value (also known as Vstartboost) by using a comparator circuit 14*b*. When the boost voltage after passing through the low-pass filter 14*a* exceeds the boost stop threshold value (see (C) in FIG. 2, indicating that condition (i) is satisfied), the boost voltage monitor 14 switches an output (to a first input terminal of the logical AND circuit 16) from OFF to ON, and thereafter holds the output ON until switching the output from ON to OFF (indicating that a condition (ii) is satisfied) when the boost voltage after passing through the low-pass filter 14*a* becomes equal to or lower than the boost start threshold value (also known as Vstopboost).

For simplicity and possible use in equations, the following terms and variables are introduced.

"Filtered boost voltage" (Vfboost) defines the boost voltage (Vboost) after passing through the low-pass filter 14*a*.

"Vstartboost" is the boost start threshold value.

"Vstopboost" is the boost stop threshold value.

Looking at the "BOOST VOLTAGE MONITOR OUTPUT" in FIG. 2 (the fifth graph), note that the output is ON during periods beginning with condition (i) (Vfboost>Vstopboost) and ending with condition (ii) (Vfboost<Vstartboost). Also note that the output remains ON during these periods even when the first condition stops being satisfied.

Figure 7A:
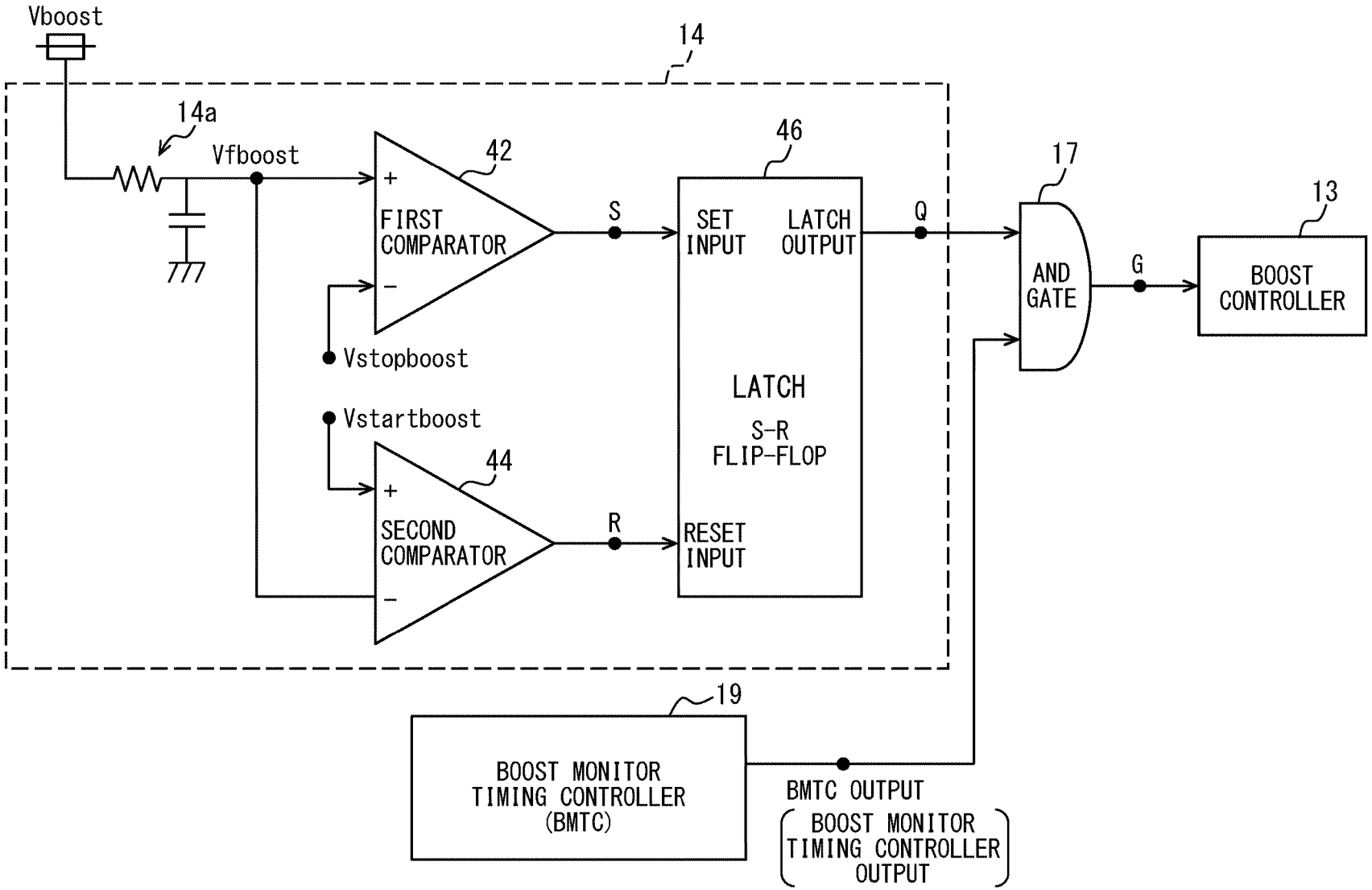
FIG. 7A is a detailed embodiment of the boost voltage monitor including two comparators and a latch.

Thus, boost voltage monitor 14 includes a memory function that remembers that condition (i) was satisfied until that memory is lost/erased when condition (ii) is satisfied. This memory logic may be performed quickly and cheaply with a relatively simple (and cheap, and fast) circuit called a flip-flop, as shown in FIG. 7A. Alternatively, the memory function may be performed by the boost controller 13, see FIG. 7B.

A flip-flop (or latch) is a circuit that has two stable states and can be used to store state information—a bistable multivibrator. The circuit can be made to change state by signals applied to one or more control inputs and will have one or two outputs.

The boost voltage monitor 14 is a flip-flop (or latch) that turns ON (or flips ON, or latches ON) when condition (i) is satisfied, and then turns OFF (or flips OFF, or latches OFF) when condition (ii) is satisfied.

In FIG. 1, a low pass filter and a comparator are shown as part of the boost voltage monitor 14. However, more detail is useful for understanding this circuit. In one embodiment (not shown), the boost voltage monitor 14 may include: a low pass filter; a first comparator (Vfboost>Vstopboost?); a second comparator (Vfboost<Vstartboost?); and a flip-flop or latch configured to flip ON when condition (i) is satisfied, and to flip OFF when condition (ii) is satisfied. The initialization status of the flip-flop would be OFF. Other minor parts in the boost voltage monitor 14 may include voltage dividers and digital-to-analog converters.

When the boost controller 13 determines that the output terminal of the logical AND circuit 16 is switched from OFF to ON, the boost controller 13 shifts the monitor mode from the continuous monitor mode to the section monitor mode, by outputting a boost monitor section switch instruction to the boost monitor timing controller 15 for a switching of a boost monitor timing control, i.e., for switching from OFF (i.e., invalid) to ON (i.e., valid) of such control.

When the boost monitor timing controller 15 inputs the boost monitor section switch instruction from the boost controller 13, the boost monitor timing control is switched from invalid to valid, and the boost monitor timing controller 15 sets a boost monitor section for each of the boost switching control of the boost switch (not shown) in the section monitor mode (See (D) in FIG. 2). By inputting the on-edge timing of the boost switch 9 from the boost controller 13, the boost monitor timing controller 15 sets a boost monitor section by a timer counter 15*a*, which is a section (i.e., a period of time) (a) from a timing after a predetermined time from the on-edge timing of the boost switch 9 (b) to the off-edge timing of the boost switch 9.

In other words, looking at FIG. 2, starting at point (C), the boost switch turns ON, and a predetermined time elapses before a section is monitored at point (D). The section ends when the Boost switch turns OFF.

The boost monitor timing controller 15 switches the output to a second input terminal of the logical AND circuit 16 from OFF to ON when the timing after a predetermined time from the on-edge timing of the boost switch 9 arrives, and thereafter, when the off-edge timing of the boost switch 9 arrives, switches the output to the second input terminal of the logical AND circuit 16 from ON to OFF. That is, the boost monitor timing controller 15 keeps the output to the second input terminal of the logical AND circuit 16 to ON in the boost monitor section. The boost monitor timing controller 15 sets a boost monitor section for each boost switching control of the boost switch 9 to preemptively prevent an overboost situation.

The boost voltage rises as the boost switching control by the boost switch 9 progresses, but if the boost voltage does not reach a target voltage value, the boost voltage after passing through the low-pass filter 14*a* in the boost monitor section will never reach a value that is equal to or higher than the boost stop threshold value. In such a state, the output from the output terminal of the logical AND circuit 16 to the boost necessity determiner 13*a* of the boost controller 13 is OFF. Thereafter, as the boost switching control by the boost switch 9 further progresses, the boost voltage rises, and when the boost voltage reaches the target voltage value, the boost voltage after passing through the low-pass filter 14*a* in the boost monitor section becomes equal to or higher than the boost stop threshold value. (See (E) in FIG. 2). In this state, the output from the output terminal of the logical AND circuit 16 to the boost necessity determiner 13*a* of the boost controller 13 is switched from OFF to ON.

When the input from the output terminal of the logical AND circuit 16 to the boost necessity determiner 13*a* is switched from OFF to ON, the boost controller 13 determines that boosting is unnecessary, stops the boost switching control by the boost switch 9, and stops boosting of the voltage. When the boost controller 13 stops boosting, the boost controller 13 stops the output of the boost monitor section switch instruction, instructs the boost monitor timing controller 15 to switch the boost monitor timing control from valid to invalid, shift the monitor mode from the section monitor mode to the continuous monitor mode, and stops the boost necessity determination by the boost necessity determiner 13*a*. When a switch instruction to switch the boost monitor timing control from valid to invalid is input from the boost controller 13, the boost monitor timing controller 15 switches the boost monitor timing control from valid to invalid.

Next, the operation of the above configuration is described with reference to FIGS. 3 to 5. The control IC 3 monitors an occurrence of a start event of a boost monitor process at a predetermined cycle, and upon detecting the occurrence of the start event of the boost monitor process, the control IC 3 starts the boost monitor process. When the control IC 3 starts the boost monitor process, the control IC 3 starts the continuous monitor mode (S1). The control IC 3 compares the boost voltage after passing through the low-pass filter 14*a* with the boost start threshold value, and determines whether or not the boost voltage after passing through the low-pass filter 14*a* is equal to or lower than the boost start threshold value (S2). When the control IC 3 determines that the boost voltage after passing through the low-pass filter 14*a* is equal to or lower than the boost start threshold value (S2: YES), the control IC 3 starts boost switching control and starts boosting (S3).

The control IC 3 compares the boost voltage after passing through the low-pass filter 14*a* with the boost stop threshold value, and determines whether or not the boost voltage after passing through the low-pass filter 14*a* is equal to or higher than the boost stop threshold value (S4). When the control IC 3 determines that the boost voltage after passing through the low-pass filter 14*a* is equal to or higher than the boost stop threshold value (S4: YES), the control IC 3 stops the continuous monitor mode, and shifts from the continuous monitor mode to the section monitor mode (S5), and continues boosting by continuing the boost switching control (S6). The control IC 3 stops the continuous monitoring of the boost voltage by stopping the continuous monitor mode.

The control IC 3 determines whether or not it has entered the boost monitor section (S7), and if the control IC 3 determines that it has entered the boost monitor section (S7: YES), the control IC 3 monitors the boost voltage in the boost monitor section (S8), and determines whether or not the boost voltage after passing through the low-pass filter 14*a* in the boost monitor section is equal to or higher than the boost stop threshold value (S9). When the control IC 3 determines that the boost voltage after passing through the low-pass filter 14*a* in the boost monitor section is not equal to or higher than the boost stop threshold value (S9: NO), the control IC 3 returns to step S6, and repeats step S6 and subsequent steps.

On the other hand, when the control IC 3 determines that the boost voltage after passing through the low-pass filter 14*a* in the boost monitor section is equal to or higher than the boost stop threshold value (S9: YES), the control IC 3 stops the boost switching control and stops boosting (S10), and stops the section monitor mode, shifts the monitor mode from the section monitor mode to the continuous monitor mode (S11), and ends the boost monitor process, and waits for an occurrence of a start event of the next boost monitor process.

Figure 4:
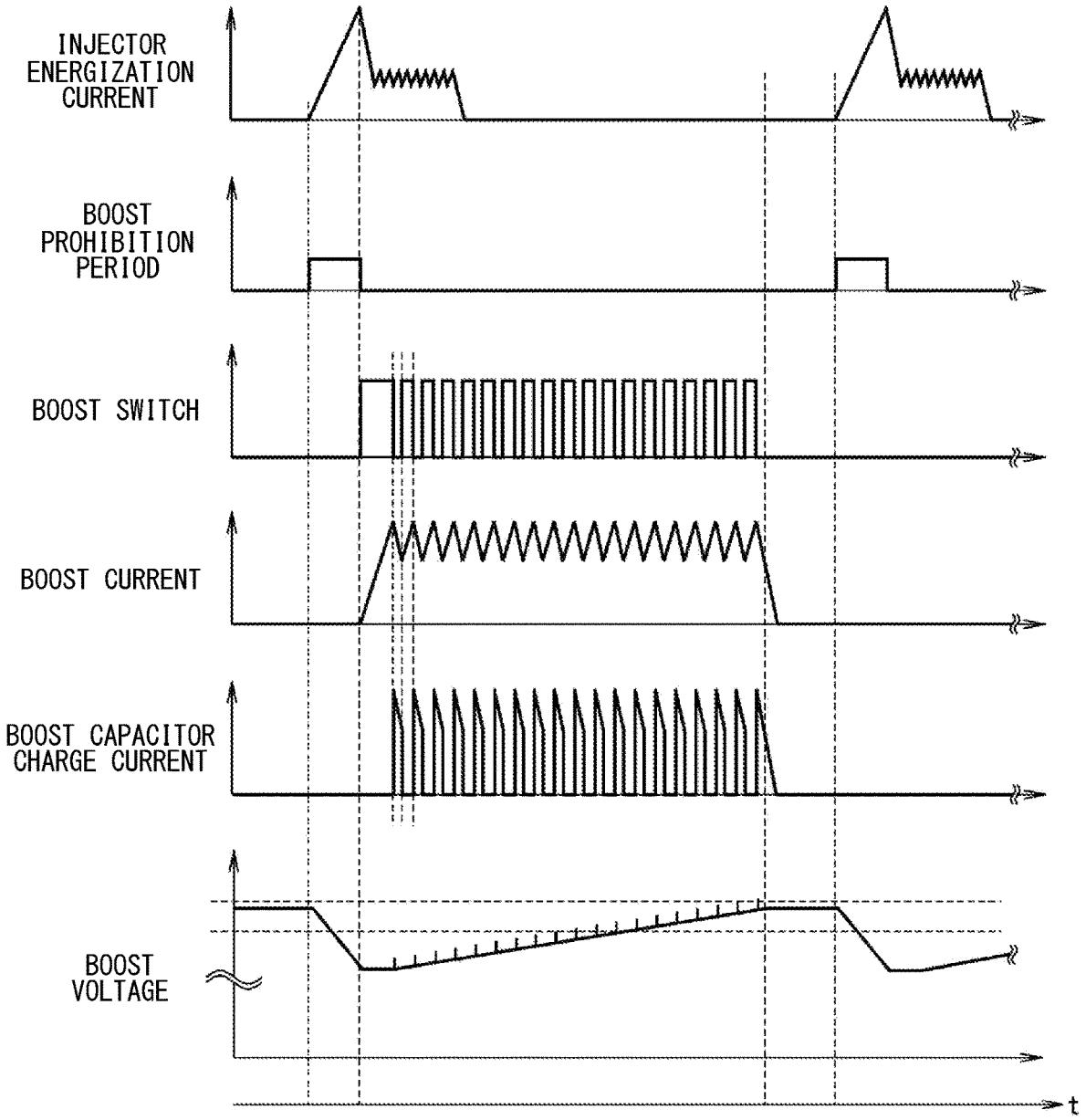
FIG. 4 is a timing chart showing a charge/discharge operation sequence.

Since the accuracy of the boost voltage affects the accuracy of the injection amount of the fuel injection valves 2*a* to 2*d*, during a high engine rotation time or multi-stage injection time which shortens the injection cycle to a minimum injection cycle, it is essential, i.e., absolutely necessary, for the boost voltage that has dropped by the discharge due to injection to reach/recover the target voltage value before the next injection as shown in FIG. 4. When the boosting is stopped, the control IC 3 can continuously monitor the boost voltage by shifting from the section monitor mode to the continuous monitor mode, and the control IC 3 is enabled to determine whether the boost voltage has reached the target voltage value before the next injection.

Figure 5:
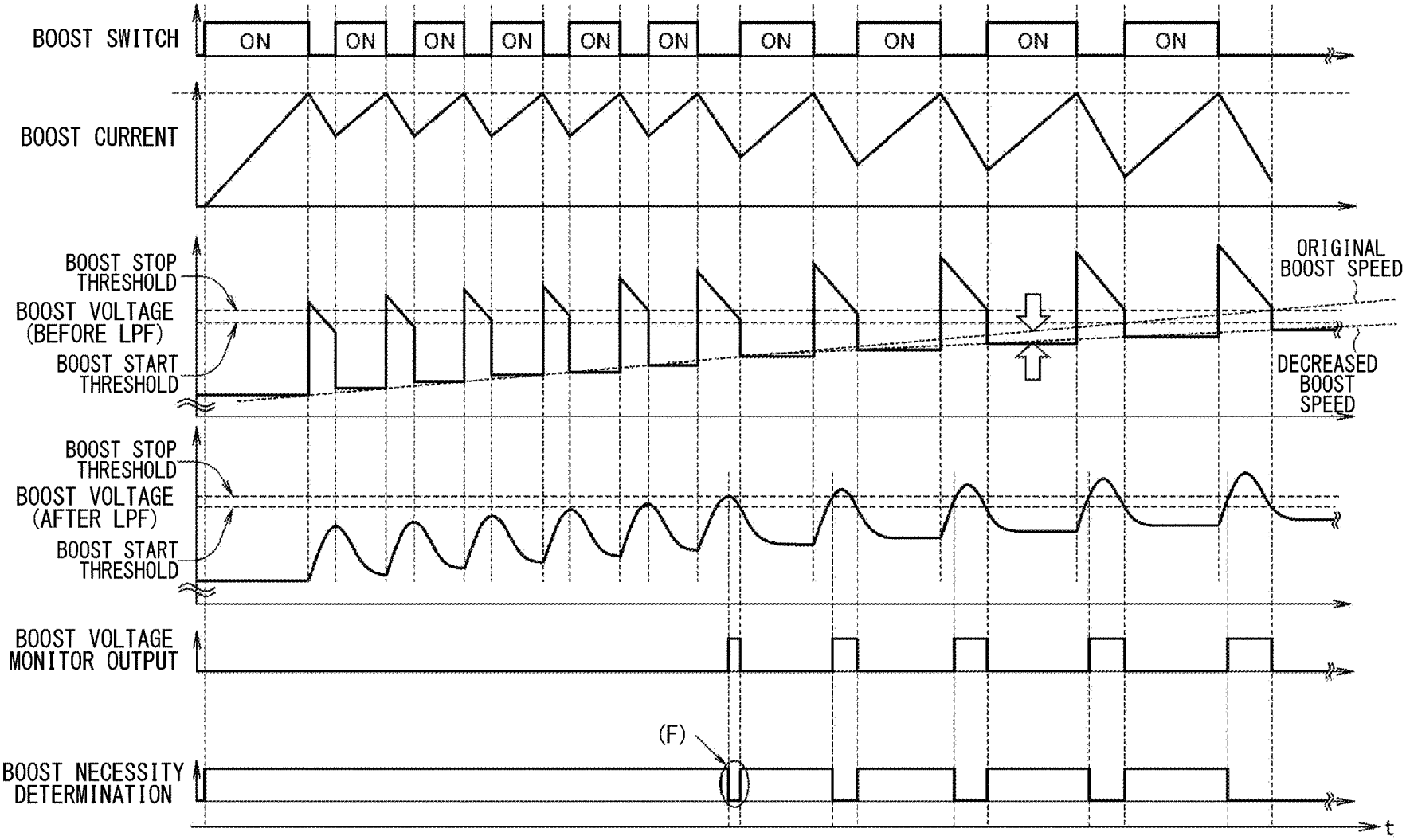
FIG. 5 is a timing chart showing an operation sequence of boost stop determination of a comparison example.

As shown in FIG. 5, in the conventional configuration in which the boosting is simply stopped when the boost voltage is equal to or higher than the boost stop threshold value, the timing of the boosting stop is erroneously determined (see (F) in FIG. 5)). If the timing of stopping the boosting is erroneously determined, an OFF time of the boost switch gradually becomes longer, the time required to increase the boost voltage from the start of boosting to a target voltage becomes longer, and the boost speed decreases. On the other hand, in the present embodiment, the section (a) from a timing after lapse of the predetermined time from the on-edge timing of the boost switch (b) to the off-edge timing is set as the boost monitor section, and when the boost voltage is equal to or higher than the boost stop threshold value in the set boost monitor section, by stopping the boost switching control for stopping boosting, it is possible to avoid a decrease in the boost speed.

According to the first embodiment, in the injection control device 1, in view of the fact that the boost voltage jumps up due to the ESR which is a DC resistance component of the boost capacitor 12, by setting the boost monitor section (a) from a timing after lapse of the predetermined time from the on-edge timing of the boost switch 9 (b) to the off-edge timing thereof, upon detecting an increase of the boost voltage in such boost monitor section being equal to or higher than the boost stop threshold value, the boost switching control is stopped for stopping boosting. As a result, unlike the conventional, simple configuration in which the boosting is stopped when the boost voltage exceeds (i.e., is equal to or greater than) the boost stop threshold, the timing of stop of boosting is more appropriately determinable by determining the boost voltage in the boost monitor section. As a result, it is possible to avoid a decrease in the boost speed, and it is possible to appropriately perform injection control.

In the injection control device 1, when the boost voltage is equal to or higher than the boost stop threshold value in the continuous monitor mode, the continuous monitor mode is shifted to the section monitor mode. By providing a continuous monitor mode that continuously monitors the boost voltage, it is possible to continuously determine whether or not the boost voltage is equal to or lower than the boost start threshold value, and when the boost voltage is equal to or lower than the boost start threshold value, boosting can be started quickly.

In the injection control device 1, when the boosting is stopped, the section monitor mode is shifted to the continuous monitor mode. By shifting to the continuous monitor mode, the next start of boosting can be appropriately prepared, and when the boost voltage becomes equal to or lower than the boost start threshold value, the boosting can be started quickly.

In the injection control device 1, the boost monitor section is set for each boost switching control. Thus, it is possible to avoid the situation of overpressurization.

The injection control device 1 is provided with a timer counter 15*a* for measuring a predetermined time. By setting the predetermined time as a count value of the timer counter 15*a*, the boost monitor section can be set by the count value of the timer counter 15*a*.

Second Embodiment

Figure 6:
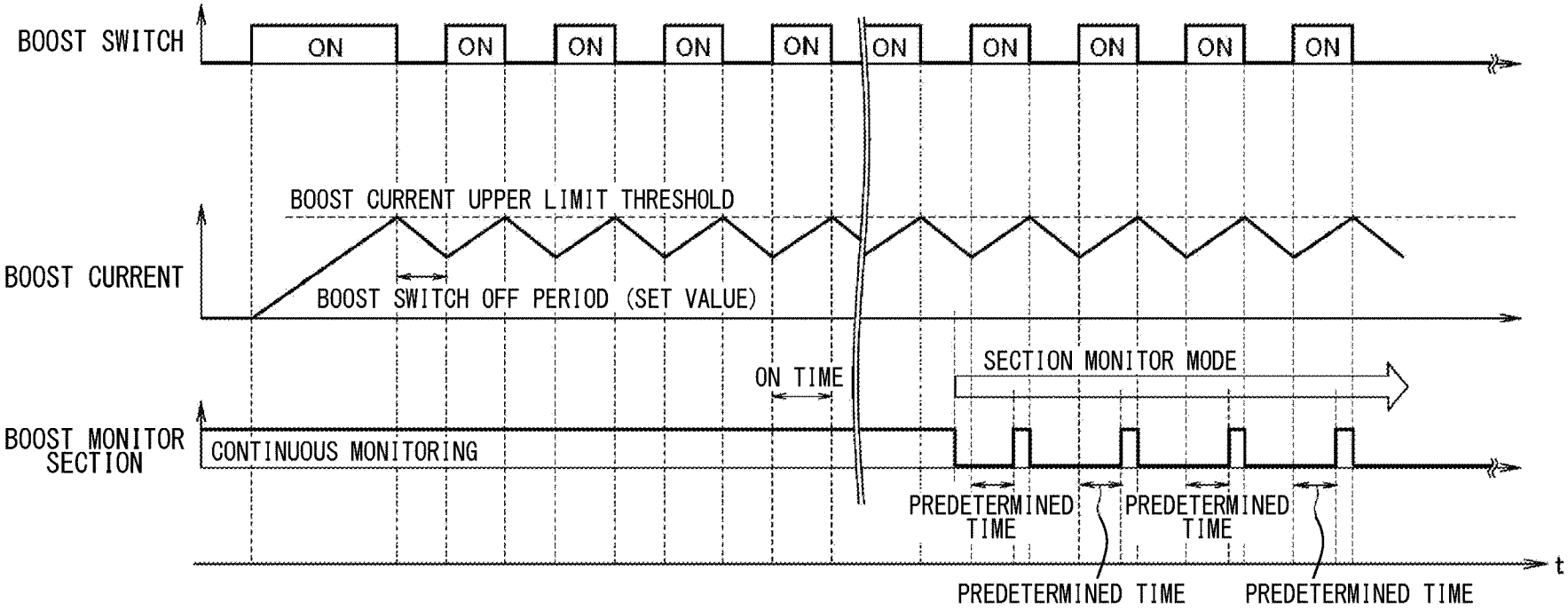
FIG. 6 is a timing chart showing an operation sequence of boost stop determination according to the second embodiment.

A second embodiment is described with reference to FIG. 6. In the second embodiment, the boost current on the downstream side of the boost switch 9 is monitored, and the boost switch 9 is turned ON until the boost current reaches an upper limit threshold value, and the boost switch 9 is turned OFF for a preset off time, and such an ON and OFF of the boost switch 9 are repeated to boost the voltage. Alternatively, the downstream current of the boost capacitor 12 may be monitored, and the OFF time may be measured by the downstream current of the boosting capacitor 12.

The gradient of the boost current during boost switching control fluctuates greatly depending on the battery voltage and the temperature characteristics of the boost coil. If an ON time of the boost switching control fluctuates, it also affects the monitor section. Therefore, if the worst case is considered for setting the ON time, the range of effect will decrease. Therefore, it is possible to maximize the effect by making the predetermined time proportionally follow the change of the ON time of the boost switching control.

The boost monitor timing controller 15 measures the ON time of the boost switching control, and sets a time obtained by subtracting an arbitrary time from the ON time as a predetermined time. The arbitrary time is a time/duration required for monitoring, and is the time including a filter time (including a soft filter) and a processing time of a determination logic. Further, the boost monitor timing controller 15 measures the ON time of the boost switching control, and sets the time calculated as proportional to the ON time as a predetermined time. The time that is proportional to the ON time is a time obtained by multiplying the ON time by a predetermined coefficient (for example, 80% or the like).

According to the second embodiment, the injection control device 1 can achieve the same effects as those of the first embodiment, can avoid a decrease in the boost speed, and can appropriately perform the injection control.

In the injection control device 1, the predetermined time is set variably. For example, an optimum predetermined time can be set by variably setting the predetermined time by software in consideration of the battery voltage, the temperature characteristics of the boost coil 8, and the like, and the optimum boost monitor section can be set.

In the injection control device 1, a time obtained by subtracting an arbitrary time from the ON time of the boost switching control is set as a predetermined time. A predetermined time can be set by subtracting an arbitrary time from the ON time with reference to the ON time of the boost switching control.

In the injection control device 1, the time calculated to be proportional to the ON time of the boost switching control is set as the predetermined time. A predetermined time can be set by calculating a time that is proportional to the ON time with reference to the ON time of the boost switching control.

In the injection control device 1, the ON time of the boost switching control in the continuous monitor mode is measured, and a predetermined time is set based on the ON time of the boost switching control in the continuous monitor mode. The influence of variation can be reduced by adopting an average value of a predetermined number of times of measurement of the ON time as the ON time of the boost switching control in the continuous monitor mode immediately before shifting to the section monitor mode.

Figure 7B:
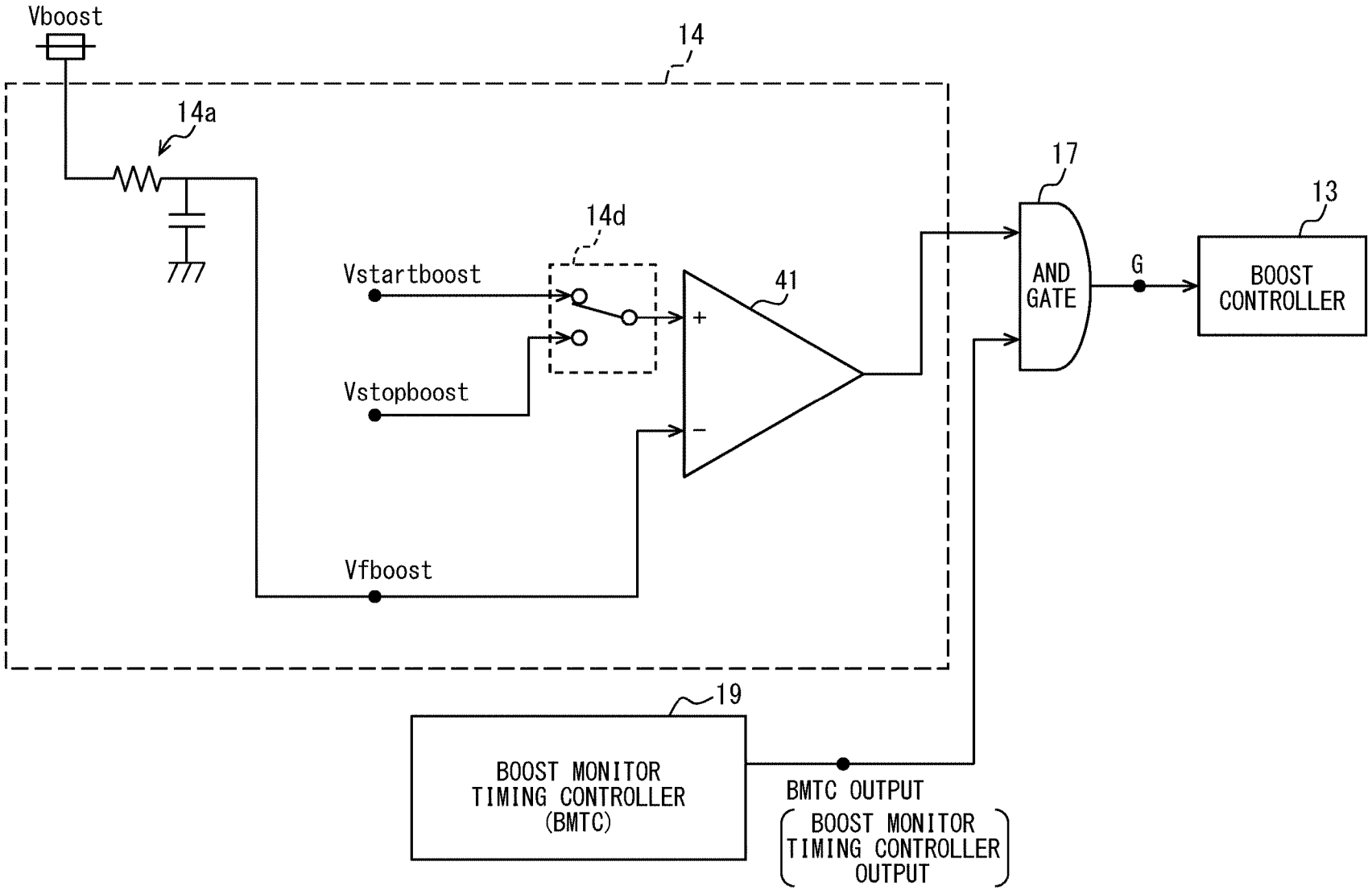
FIG. 7B is a detailed embodiment of the boost voltage monitor including one comparator and a switch.
Figure 8:
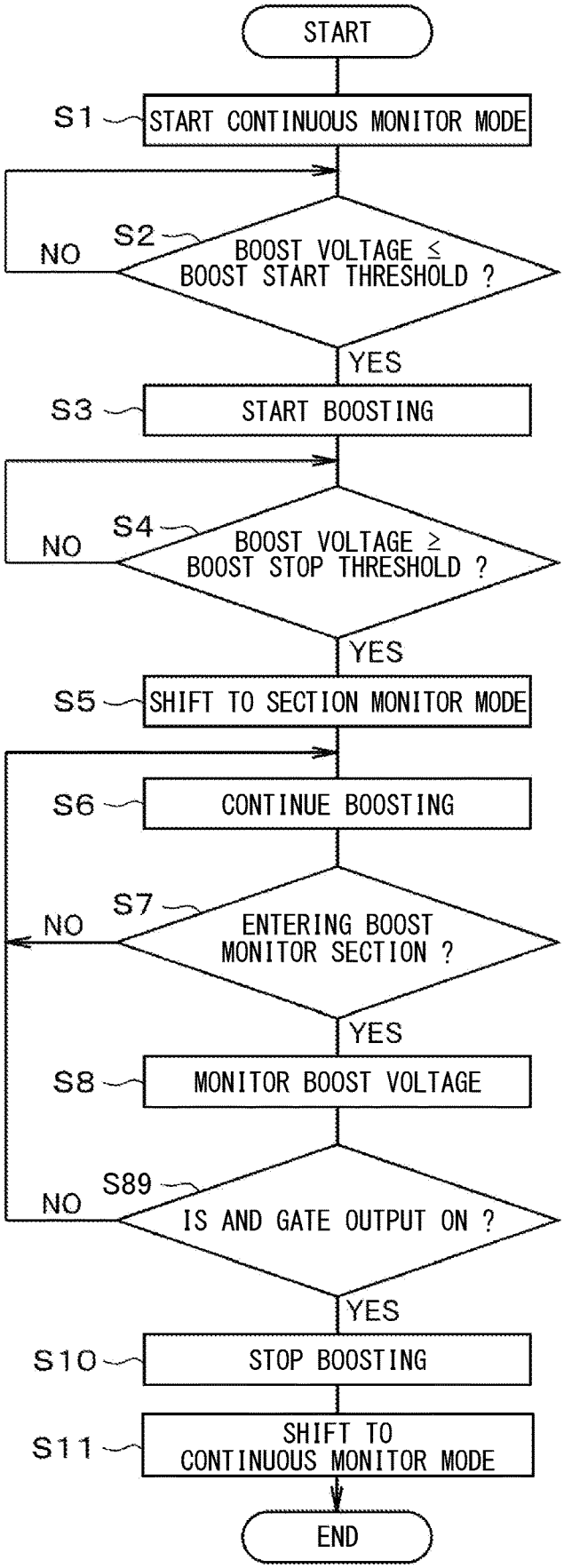
FIG. 8 is a flowchart using the detailed embodiment of the boost voltage monitor, replacing step 8 of FIG. 3 with step 89.

Detailed Boost Voltage Monitor Including Latch, FIG. 7A, 7B, 8

FIG. 7A is a detailed embodiment of the boost voltage monitor 14 including a latch 46. The boost voltage monitor 14 may include: the low-pass filter 14*a*; a first comparator 42; a second comparator 44; and a memory circuit such as a latch 46.

The low-pass filter 14*a* receives the boost voltage Vboost and outputs a filtered boost voltage Vfboost.

The first comparator 42 receives the filtered boost voltage Vfboost and compares it to a boost stop threshold value Vstopboost. If Vfboost>Vstopboost (see point C in FIG. 2), then the first comparator output S is ON or HI. Output S acts as a Set input for the latch 46.

The second comparator 44 receives the boost start threshold value Vstartboost and compares it to the filtered boost voltage Vfboost. If Vstartboost>Vfboost, then the second comparator output R is ON or HI. Output R acts as a Reset input for the latch 46.

The latch 46 may be an S-R (set-reset) flip-flop, and receives the first comparator 42 output S as a set input that sets an output Q to ON or HI when the set input transitions (leading edge rise) from OFF to ON (or from LOW to HI). Some latches use leading edges of inputs, some latches use an input value at a clocked time. Upon receiving a setting input (S=ON), the latch sets the latch output Q to ON. Note, an additional latch output (not shown) may be set to OFF.

After being set or latched due to S=ON, the latch maintains a set output (Q=ON) even if the setting input S changes to S=OFF. Thus, the latch is a memory. Specifically, the latch (or flip-flop) is a circuit that has two stable states and can be used to store state information—a bistable multivibrator. The circuit can be made to change state by signals applied to one or more control inputs and will have one or two outputs. More complex circuits with more inputs and/or more outputs may be used, if they include at least one bit of memory.

After being set or latched to Q=ON, the latch may be reset (to Q=OFF) by inputting a reset input R=ON or HI. Thus, the reset effectively clears the memory, and resets the output to an initial or default value of Q=OFF or LOW.

In the present embodiment, the memory function is essential because the latched output Q to the AND gate 16 must remain set ON (even if Vfboost falls below Vstopboost) until the resetting condition (Vfboost<Vstartboost) is satisfied in the second comparator 44.

This setting, holding due to memory, then resetting is illustrated by the output pulses shown in the 5th graph in FIG. 2 for the Boost Voltage Monitor Output Q. The setting and resetting conditions are shown in the 4th graph in FIG. 2 for the boost voltage after the low pass filter, also known as the filtered boost voltage Vfboost.

FIG. 7B is a detailed embodiment of the boost voltage monitor 14 without the latch. In FIG. 7B, a single comparator 41 and a switch 14*d* are used to perform the functions of the two comparators in FIG. 7A. The memory function of the latch in FIG. 7B may be performed by the boost controller 13. Relative to FIG. 7A, FIG. 7B uses one less comparator, one less latch, and one more switch.

Figure 3:
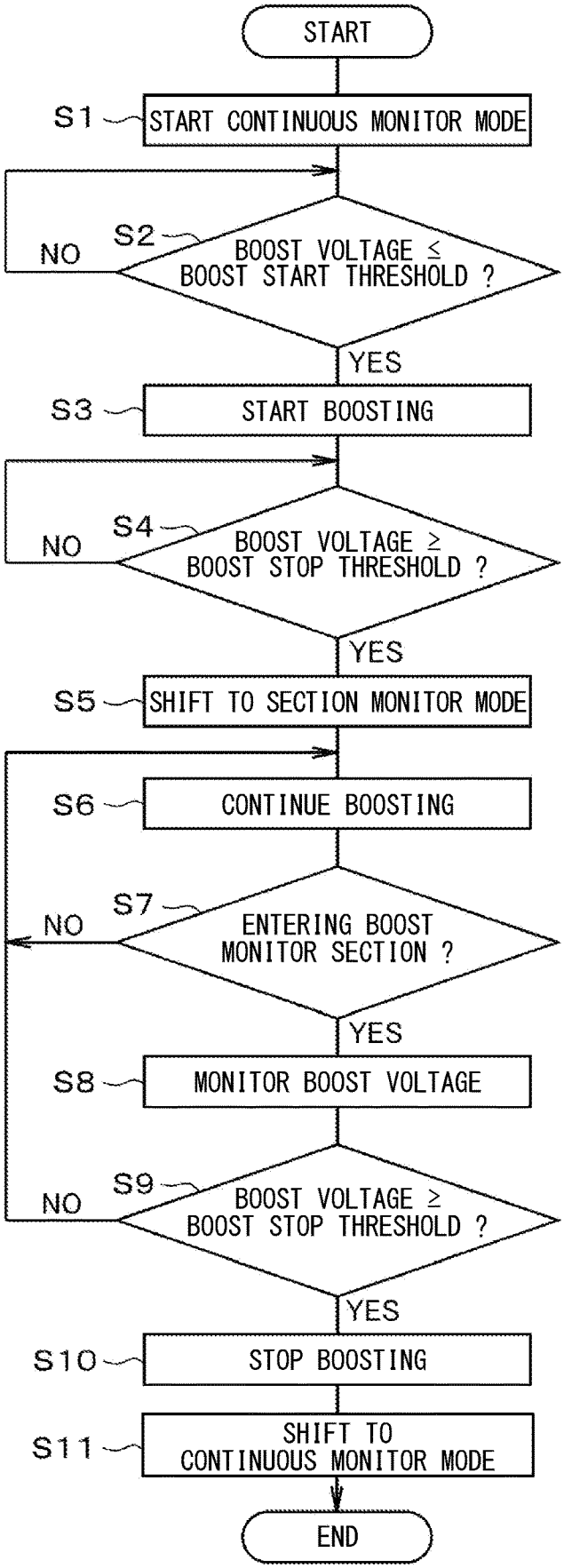
FIG. 3 is a flowchart of operation of an injection control device.

FIG. 8 is similar to FIG. 3, except that step S8 in FIG. 3 is replaced by step 89 in FIG. 8. Step 89 states, "is AND gate output ON".

Other Embodiments

Although the present disclosure has been described in accordance with the examples, it is understood that the present disclosure is not limited to such examples or structures. The present disclosure incorporates various modifications and variations within the scope of equivalents. Additionally, various combinations and configurations, as well as other combinations and configurations including more, less, or only a single element, are within the scope and spirit of the present disclosure.

What is claimed is:

1. An injection control device comprising:

a boost controller performing a boost switching control of a boost switch to charge a boost capacitor and supplying a boost power from a battery power supply;

a boost voltage monitor monitoring the boost voltage after passing a low-pass filter; and a boost monitor timing controller setting a section from a predetermined time after an on-edge of the boost switch to an off-edge timing in a section monitor mode as a boost monitor section, wherein the boost controller stops boosting by stopping the boost switching control when the boost voltage is equal to or higher than a boost stop threshold value in the boost monitor section, the predetermined time is set to a time that is required for the boost voltage to decrease by a predetermined amount or more after a delay, which is from a peak value of the boost voltage and caused by the low-pass filter.

2. The injection control device of claim 1, wherein the boost controller shifts from a continuous monitor mode that continuously monitors the boost voltage to the section monitor mode when the boost voltage becomes equal to or higher than the boost stop threshold value in the continuous monitor mode.

3. The injection control device of claim 2, wherein the boost controller shifts from the section monitor mode to the continuous monitor mode when the boosting is stopped.

4. The injection control device of claim 1, wherein the boost monitor timing controller sets the boost monitor section for each boost switching control.

5. The injection control device of claim 1, wherein the boost monitor timing controller includes a timer counter for measuring the predetermined time.

6. The injection control device of claim 1, wherein the boost monitor timing controller variably sets the predetermined time.

7. The injection control device of claim 1, wherein the boost monitor timing controller measures an ON time of the boost switching control, and sets a time obtained by subtracting a first time from the ON time as the predetermined time, and the first time includes at least a filter time.

8. The injection control device of claim 1, wherein the boost monitor timing controller measures an ON time of the boost switching control, and sets a time calculated as proportional to the ON time as the predetermined time.

9. The injection control device of claim 7, wherein the boost monitor timing controller measures the ON time of the boost switching control in a continuous monitor mode in which the boost voltage is continuously monitored, and sets the predetermined time based on the measured ON time.

10. The injection control device of claim 1, wherein the boost controller sets a boost start threshold value to a value smaller than the boost stop threshold value.

11. The injection control device of claim 7, wherein the first time includes the filter time and a processing time of a determination logic of the boost controller.

12. The injection control device of claim 1, wherein the boost controller does not stop the boost switching, outside the boost monitor section, when the boost voltage is equal to or higher than the boost stop threshold value.

* * * * *